US007134890B2

(12) United States Patent
Wang

(10) Patent No.: US 7,134,890 B2
(45) Date of Patent: Nov. 14, 2006

(54) ELECTRICAL CONNECTOR WITH IMPROVED STRUCTURE

(75) Inventor: Wei Che Wang, Tu-Chen (TW)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 11/145,075

(22) Filed: Jun. 3, 2005

(65) Prior Publication Data

US 2006/0063409 A1 Mar. 23, 2006

(30) Foreign Application Priority Data

Sep. 17, 2004 (TW) ..... 93214872 U

(51) Int. Cl.
*H01R 29/00* (2006.01)

(52) U.S. Cl. ..... 439/188; 439/668

(58) Field of Classification Search ..... 439/188, 439/668, 669; 200/51.1

See application file for complete search history.

(56) References Cited

U.S. PATENT DOCUMENTS 5,007,851 A 4/1991 Matsumoto
5,075,518 A * 12/1991 Matsumoto ..... 200/51.09
6,077,126 A * 6/2000 Peng ..... 439/668
6,382,999 B1 * 5/2002 Mou et al. ..... 439/188
6,551,115 B1 4/2003 Li et al.
6,575,793 B1 * 6/2003 Li et al. ..... 439/668
6,690,801 B1 * 2/2004 Yeh ..... 381/77
6,923,687 B1 * 8/2005 Wang ..... 439/668

* cited by examiner

*Primary Examiner*—Gary F. Paumen
(74) *Attorney, Agent, or Firm*—Wei Te Chung

(57) ABSTRACT

An electrical connector (7) includes an insulative housing (1) having front and rear faces (10, 20). A first and a second receiving rooms (101, 102), which communicate with each other are defined in the insulative housing (1) and extend forwardly from the rear face (20). A third receiving room (103) is defined in the insulative housing (1) and extends forwardly from the rear face (20) as well. A retaining cavity (6) is in communication with the third receiving room (103). A resilient contact (2) is received in the first receiving room (101) and comprises a first contacting portion and a first connecting portion (23) beyond the rear face (20). A central contact (4) comprises a plate portion (41) received in the third receiving room (103), a fork-type contacting portion (42) extending forwardly from the plate portion (41) and a third connecting portion (43). The plate portion (41) has a retention member (44) for engagement with the retaining cavity (6).

19 Claims, 5 Drawing Sheets

7

ELECTRICAL CONNECTOR WITH IMPROVED STRUCTURE

BACKGROUND OF THE INVENTION

1. Field of the Invention

The present invention generally relates to an electrical connector and, more particularly, to a power jack.

2. Description of the Prior Art

An electric product such as a notebook computer, a PDA, a digital camera or the like is required to be made as compactly as possible, therefore, electrical connectors used therein are also strongly required to be made in extremely compact designs by minimizing outer dimensions thereof. U.S. Pat. No. 5,007,851 issued to Hosiden on Apr. 16, 1991 discloses a power socket having a housing, a pin, a stationary contact and a movable contact, all of which are received in the housing. The pin and the stationary and movable contacts are disposed in a direction parallel to a mounting surface of a printed circuit board on which the power socket is mounted. The pin is secured to the housing of the power socket by an additional engagement fixing body integrally formed with a rear wall of the housing. Therefore, the occupied space of the power socket on the printed circuit board is increased, which is out of current trend. The engagement fixing body has a complex structure, thus, increasing manufacturing difficulty and cost.

Hence, an electrical connector having thin improved structure is required to overcome the disadvantage of the prior art.

BRIEF SUMMARY OF THE INVENTION

It is an object of the present invention to provide an electrical connector, which has a low profile.

In order to achieve the above-mentioned object, an electrical connector in accordance with the present invention includes an insulative housing having a body portion and an annular section extending from the body portion. The body portion has a front face and a rear face. A first receiving room, which receives a resilient contact is defined in the rear face of the body portion and extends into the body portion. A second receiving room communicating with the first receiving room is defined in the rear face of the body portion and extends into the body portion. A third receiving room is defined in the rear face of the body portion and extends into the body portion. A retaining cavity is defined in the body portion of the insulative housing and in communication with the third receiving room. A central contact has a retention member engaging with the retaining cavity.

Additional novel features and advantages of the present invention will become apparent by reference to the following detailed description when taken in conjunction with the accompanying drawings.

DETAILED DESCRIPTION OF THE INVENTION

Reference will now be made in detail to a preferred embodiment of the present invention.

Figure 1:
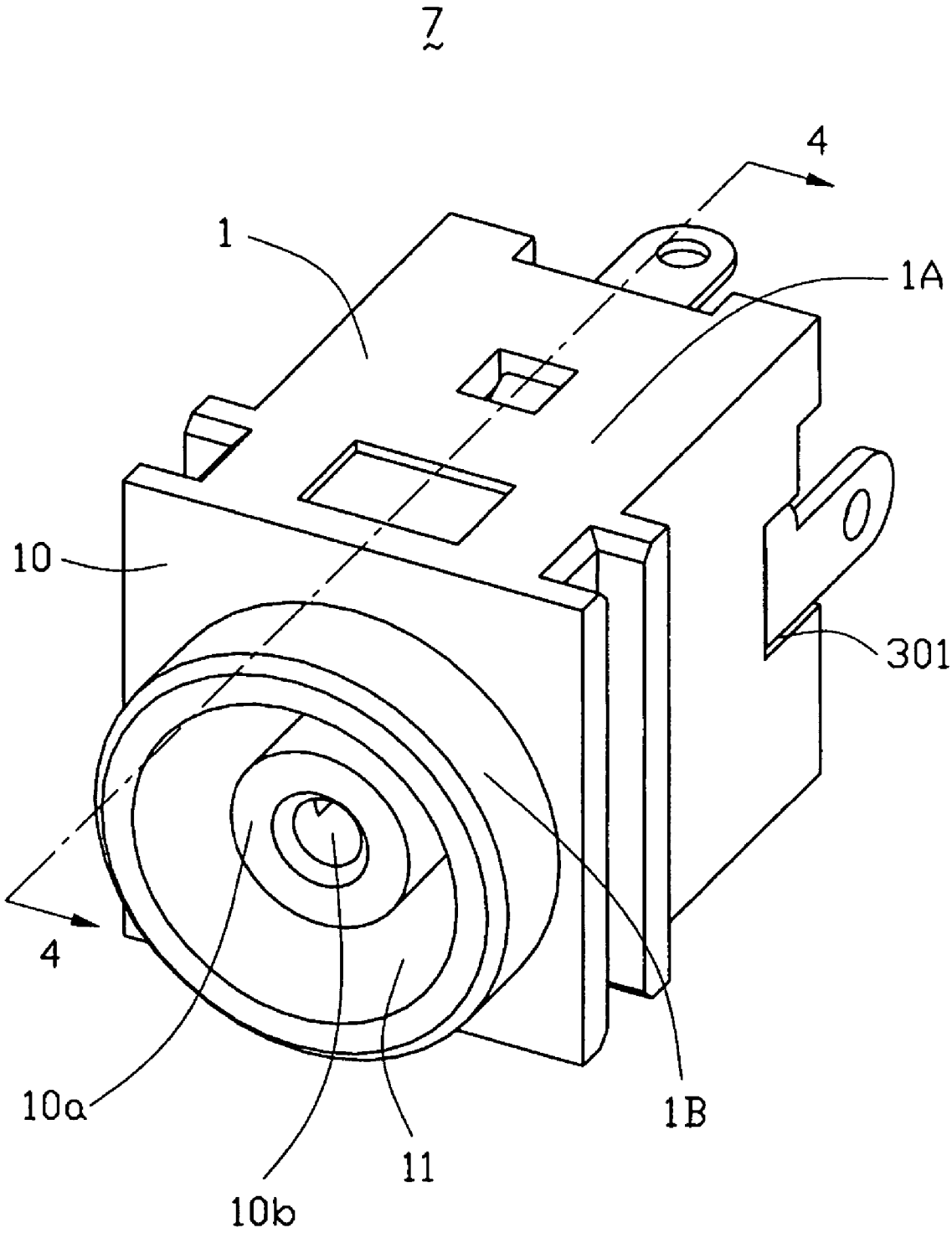
FIG. 1 is a front perspective view of an electrical connector in accordance with the present invention.
Figure 2:
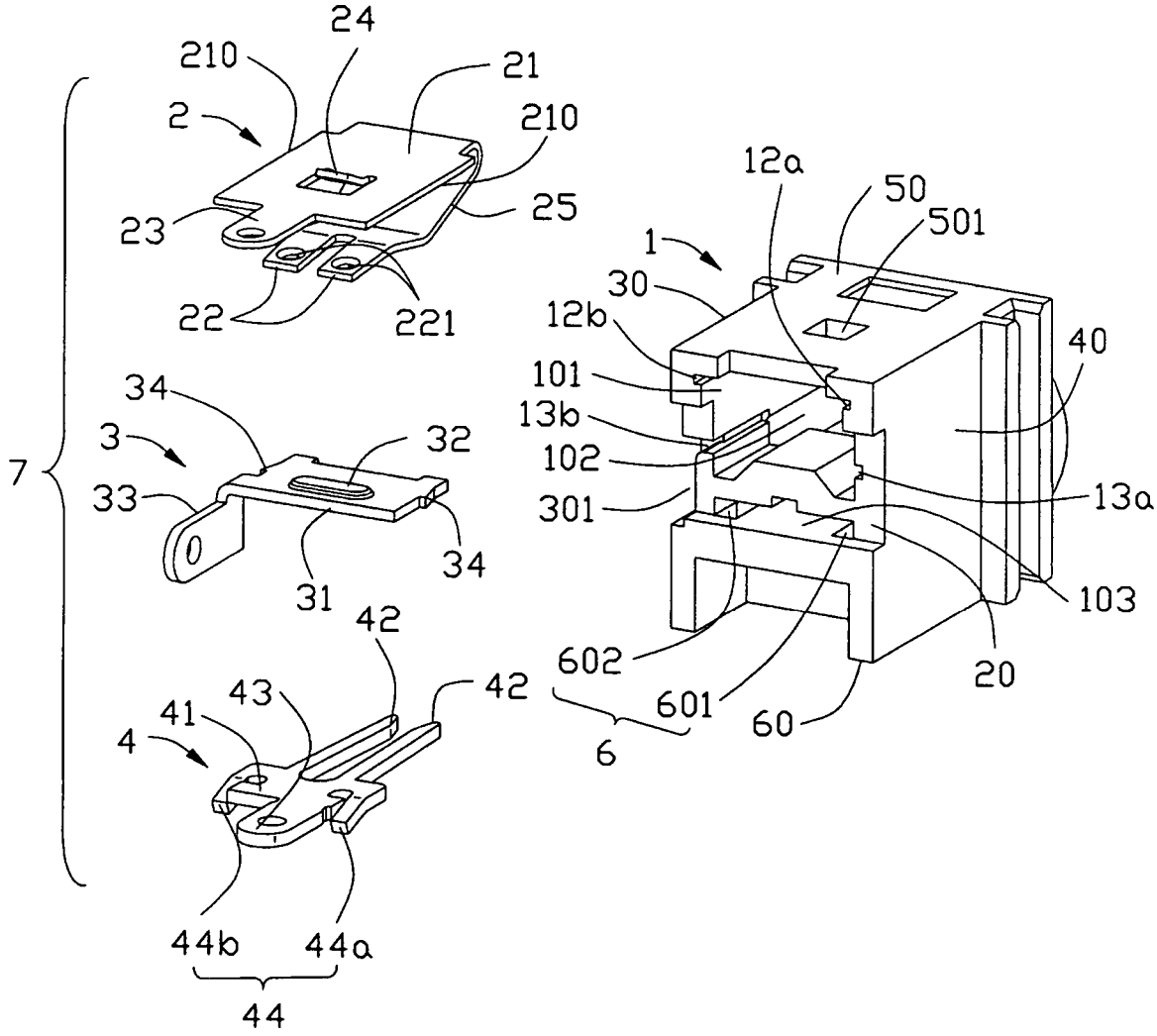
FIG. 2 is a rear exploded, perspective view of the electrical connector in accordance with the present invention.

Referring to FIG. 1 and FIG. 2, an electrical connector 7 in accordance with the present invention includes an insulative housing 1, a central contact 4 accommodated in the insulative housing 1, a resilient contact 2 and a fixed contact 3 located in the insulative housing 1 above the central contact 4. The contacts 2, 3, 4 are stamped and configured from metal sheets.

The insulative housing 1 comprises a body portion 1A and an annular section 1B extending forwardly from the body portion 1A. The body portion 1A comprises a front face 10 from which the annular section 1B extends, a rear face 20 opposite to the front face 10, opposite left and right lateral walls 30, 40, and opposite upper and lower surfaces 50, 60. The body portion 1A has a first receiving room 101, a second receiving room 102 and a third receiving room 103. The first receiving room 101, which is located adjacent to the upper surface 50 of the body portion 1A, is defined in the rear face 20 and extends forwardly into the body portion 1A. The second receiving room 102 in communication with and below the first receiving room 101 is defined in the rear face 20 and extends forwardly into the body portion 1A. The third receiving room 103 below but not communicating with the second receiving room 102 is defined in the rear face 20. A post 10*a* is formed in the body portion 1A and extends beyond the front face 10. The post 1*a* defines a passageway 10*b*, which communicates with the third receiving room 103. The annular section 1B is positioned outside the post 10*a* and beyond the front face 10 of the body portion 1A. The annular section 1B and the post 10*a* define a receiving space 11 therebetween, which extends in a predetermined distance in the body portion 1A and communicates with the first and second receiving rooms 101, 102. With the existence of the post 10*a* and the annular section 1B, a mating plug (not shown) cooperates with the electrical connector 7 correctly and properly by a pin of the plug inserted into the passageway 10*b* and a sleeve of the plug into the receiving space 11. The left and right lateral walls 30, 40 are respectively provided in inner surfaces thereof with notches 12*a*, 13*a*, 12*b*, 13*b* for holding the resilient and fixed contacts 2, 3. A cutout 301 is defined in the outer surface of the left lateral wall 30. A retaining cavity 6 close to the rear face 20 is defined in the body portion 1A and comprises a first retaining groove 601 and a second retaining groove 602, which locate at opposite sides of the third receiving room 103 and extends downward for retaining the central contact 4, which will be detailed hereinafter.

Figure 3:
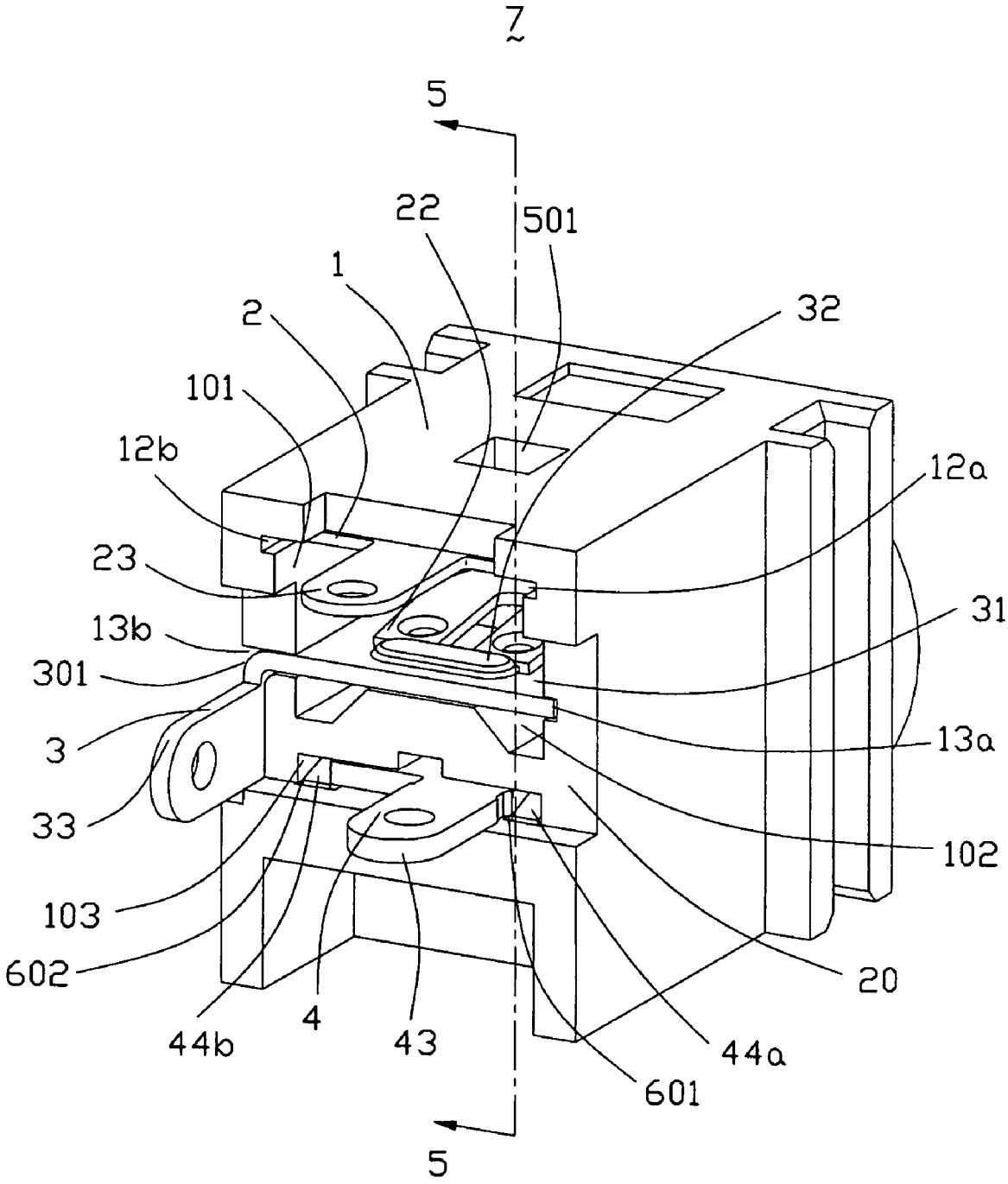
FIG. 3 is an assembled view of FIG. 2.
Figure 4:
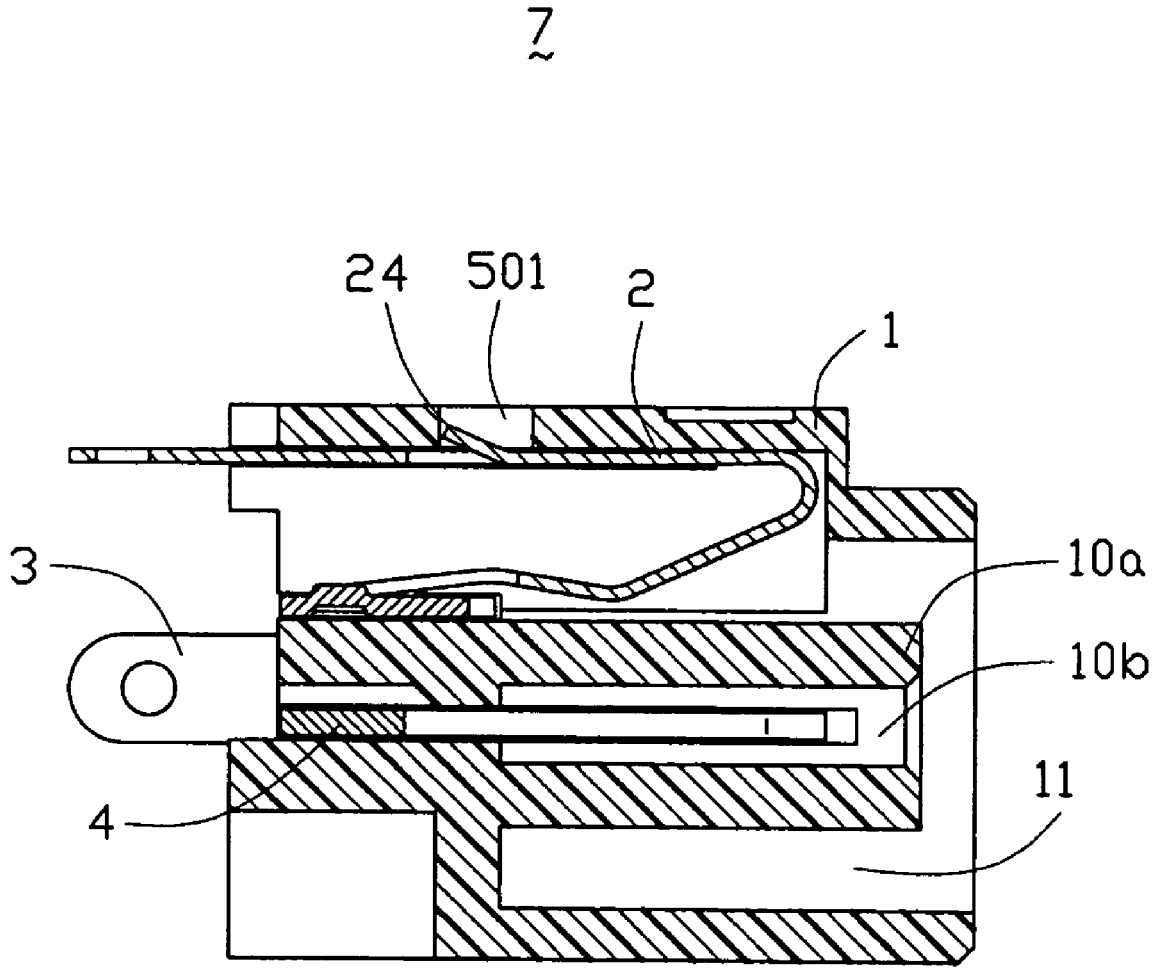
FIG. 4 is a cross-sectional view of the electrical connector taken along line 4—4 of FIG. 1.

Referring to FIG. 2 and FIG. 3, the resilient contact 2 is configured in a U-shape and comprises a first contacting portion and a first connecting portion 23. The first contacting portion comprises a plate part 21 and a resilient part 25 bending backward from a front edge of the plate part 21. The plate part 21 has a spring tab 24, which is cut and obliquely outwardly raised, and opposite edges 210. The resilient part 25 has a pair of touching fingers 22 having respective protruding points 221 positioned thereat. The first connecting portion 23 extends from a rear edge of the plate part 21. The resilient contact 2 is secured to the first receiving room 101 with opposite edges 210 inserted into corresponding notches 12*a*, 12*b*. The spring tab 24 is engaged with a stepped portion 501 formed in the upper surface 50 of the insulative housing 1 for preventing a rearward movement of the resilient contact 2, as best shown in FIG. 4. The first connecting portion 23 extends beyond the rear face 20 of the body portion 1A of the insulative housing 1 and connects to a cable (not shown).

A fixed contact 3 comprises a second contacting portion and a second connecting portion 33. The second contacting portion has a flat plate 31 with a protruding part 32 formed thereon. The second connecting portion 33 extends rearward from a rear lateral edge of the flat plate 31. The flat plate 31 is provided in the middle of lateral edges thereof with a pair of engagement pawls 34. The fixed contact 3 is secured to the second receiving room 102 with the lateral edges inserted into corresponding notches 13*a*, 13*b* and the engagement pawls 34 pressing against inner surfaces of the notches 13*a*, 13*b*. The second connecting portion 33 perpendicular to the flat plate 31 is partially received in the cutout 103 and extends beyond the rear face 20 of the body portion 1A of the insulative housing 1 for connecting to the cable. When the resilient contact 2 and the fixed contact 3 are received in the insulative housing 1, the protruding points 221 of the touching fingers 22 of the resilient contact 2 are pressed on the flat plate 31 of the fixed contact 3 and rear ends of the touching fingers 22 are leaned against the protruding part 32 of the fixed contact 3. When the mating plug cooperates with the electrical connector 7, the resilient contact 2 is separated from the fixed contact 3 by a terminal of the sleeve of the mating plug, thereby, realizing a switch function of the electrical connector 7.

Figure 5:
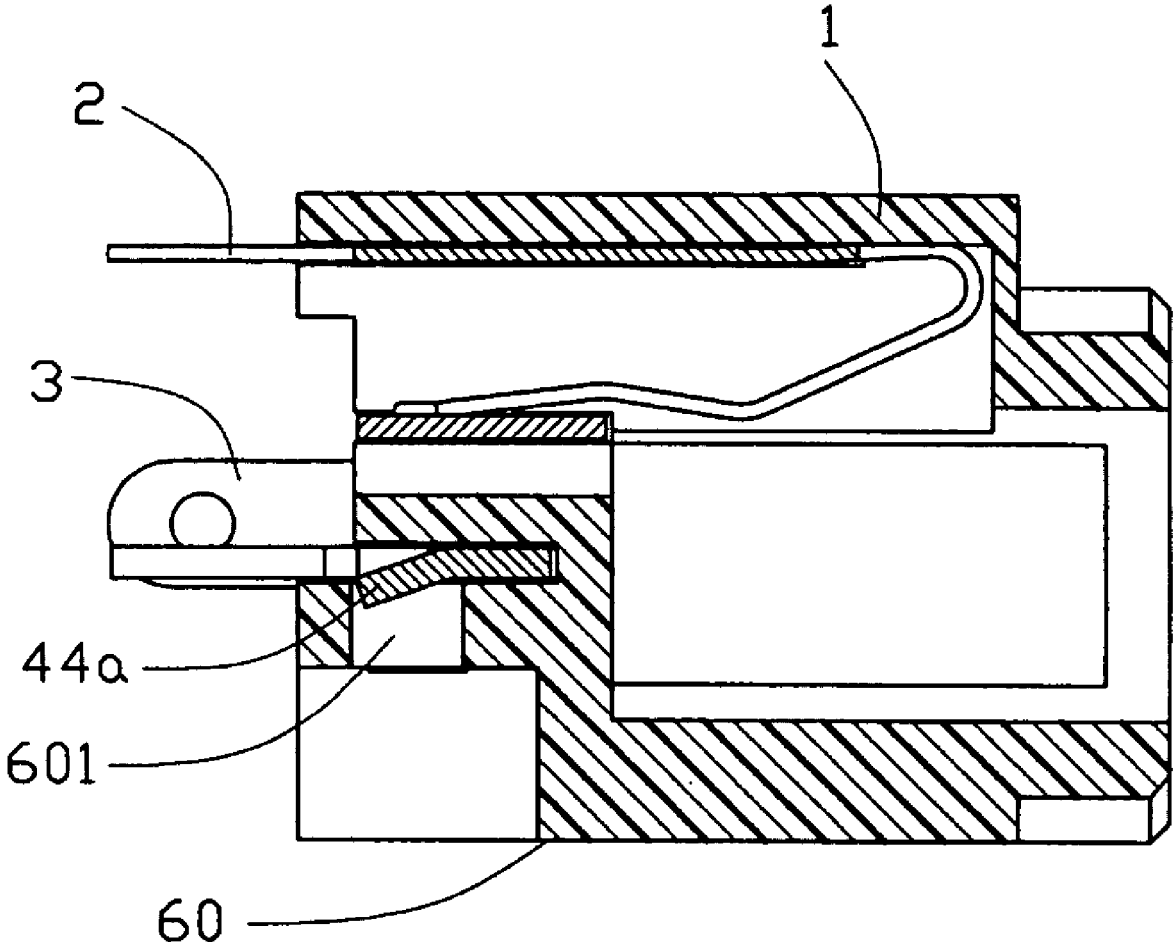
FIG. 5 is a cross-sectional view of the electrical connector taken along line 5—5 of FIG. 3.

The central contact 4 comprises a plate portion 41, a fork-type contacting portion 42 extending forwardly from a front edge of the plate portion 41 and a third connecting portion 43 extending rearward from a rear edge of the plate portion 41. The plate portion 41 has a retention member 44, which contains a first retention portion 44*a* and a second retention portion 44*b*, for engagement with the retaining cavity 6. The central contact 4 is secured into the body portion 1A with the fork-type contacting portion 42 received in the passageway 10*b* and the plate portion 41 received in the third receiving room 103. The first and second retention portions 44*a*, 44*b* extend obliquely to the corresponding retaining grooves 601, 602, as shown in FIGS. 2 and 5, so that, the central contact 4 cannot be removed from the body portion 1A of the insulative housing 1. The third connecting portion 43 not whole overlapped by but parallel to the first connecting portion 23 of the resilient contact 2 extends beyond the rear face 20 of the insulative housing 1 and connects the cable.

While the foregoing description includes details which will enable those skilled in the art to practice the invention, it should be recognized that the description is illustrative in nature and that many modifications and variations thereof will be apparent to those skilled in the art having the benefit of these teachings. It is accordingly intended that the invention herein be defined solely by the claims appended hereto and that the claims be interpreted as broadly as permitted by the prior art.

What is claimed is:

1. An electrical connector, comprising:

an insulative housing having a front face and a rear face;

a first receiving room defined in the insulative housing and extending forwardly from the rear face;

a second receiving room defined in the insulative housing and extending forwardly from the rear face, the second receiving room communicating with the first receiving room;

a third receiving room defined in the insulative housing and extending forwardly from the rear face;

a retaining cavity defined in the insulative housing and being in communication with the third receiving room;

a resilient contact being received in the first receiving room and comprising a first contacting portion and a first connecting portion beyond the rear face;

a central contact comprising a plate portion received in the third receiving room, a fork-type contacting portion extending forwardly from the plate portion and a third connecting portion, the plate portion having a retention member engagingly received in the retaining cavity.

2. The electrical connector as claimed in claim 1, wherein said retaining cavity comprises a first retaining groove and a second retaining groove, said retention member comprises a first retention portion and a second retention portion, and wherein the first retention portion engagingly received in the first retaining groove, and the second retention portion engagingly received in the second retaining groove.

3. The electrical connector as claimed in claim 2, wherein said first retaining groove and said second retaining groove are positioned at opposite sides of the third receiving room, respectively.

4. The electrical connector as claimed in claim 1, wherein the electrical connector comprises a post formed in the insulative housing and defining a passageway in communication with the third receiving room, and wherein said fork-type contacting portion of the central contact is received in the passageway.

5. The electrical connector as claimed in claim 4, wherein the insulative housing comprises a body portion and an annular section projecting forwardly from said front face, and wherein a receiving space is formed between the post and the annular section, and communicates with the first and second receiving rooms.

6. The electrical connector as claimed in claim 1, wherein the electrical connector further comprises a fixed contact received in the second receiving room, wherein the resilient contact comes in contact with or separates from the fixed contact.

7. The electrical connector as claimed in claim 6, wherein said fixed contact is stamped and configured from a metal sheet.

8. The electrical connector as claimed in claim 6, wherein said fixed contact comprises a second contacting portion and a second connecting portion, and wherein said second contacting portion comprises a flat plate with a protruding part formed thereon, the second connecting portion extending rearwardly from a lateral edge of the flat plate.

9. The electrical connector as claimed in claim 6, wherein said insulative housing further comprises a left lateral wall and a cutout is defined in the left lateral wall, and wherein the second connecting portion of said fixed contact is partially received in said cutout.

10. The electrical connector as claimed in claim 8, wherein said resilient contact comprises a touching finger, coming in contact with or separating from the protruding part of the fixing contact.

11. The electrical connector as claimed in claim 1, wherein said resilient contact comprises a spring tab and said insulative housing has a stepped portion formed in an upper surface thereof, and wherein the spring tab is engaged with the stepped portion.

12. The electrical connector as claimed in claim 1, wherein said central contact and resilient contact are stamped and configured from metal sheets.

13. An electrical connector comprising:

an insulative housing defining a circular mating port, and first, second and third receiving rooms therein, said first and second receiving rooms communicating with each other in a radial direction, the third room located essentially at a middle level of the housing and in alignment with a center of said mating port in an axial direction;

a central post formed in said mating port and defining a passageway therein which communicates with the third receiving room in the axial direction;

a first contact received in the first receiving room;

a second contact having a planar retention portion received in the second receiving room;

a third contact having a planar retaining portion received in the third receiving room, and a mating portion received in the passageway.

14. The electrical connector as claimed in claim 13, wherein said planar retention portion and said retaining portion are parallel to each other.

15. The electrical connector as claimed in claim 14, wherein said first contact constantly engages the second contact until a plug is inserted into the mating port to connect to the third contact.

16. The electrical connector as claimed in claim 15, wherein the first, second and third contacts have corresponding first, second and third solder tails, respectively, and wherein the first solder tail and the third solder tail are parallel to each other but both perpendicular to the second solder tail.

17. An electrical connector comprising:

an insulative housing defining a circular mating port therein with a post having a passageway;

first, second and third contacts sequentially disposed in the housing in a radial direction;

the first contact defining a first planar section and a curved connecting section extending backwardly from a front end of said first planar section;

the second contact defining a second planar section;

the third contact defining a third planar section and a fork-like mating section extending forwardly from the third planar section and into the passageway;

the first, second and third planar sections being parallel to one another; and the curved contacting section constantly engaged with the second contact until a plug is inserted into the mating port.

18. The electrical connector as claimed in claim 17, wherein the third planar section is essentially aligned with the passageway in an axial direction.

19. The electrical connector as claimed in claim 17, wherein a solder tail of the third contact is parallel to that of the first contact while being perpendicular to that of the second contact.

* * * * *